United States Patent [19]

Silano

[11] Patent Number: 4,789,067

[45] Date of Patent: Dec. 6, 1988

[54] CARTON

[76] Inventor: Rocco Silano, 310 Richmond Ave., Paterson, N.J. 07502

[21] Appl. No.: 129,595

[22] Filed: Dec. 7, 1987

[51] Int. Cl.[4] ..... B65D 5/54

[52] U.S. Cl. ..... 206/615; 206/605; 206/624; 206/628; 220/260; 229/125.42

[58] Field of Search ..... 229/125.42; 206/605, 206/606, 611, 624, 628, 615, 621.1, 621.2, 621.3, 631.3; 220/260, 359

[56] References Cited

U.S. PATENT DOCUMENTS

| | | | |
|---|---|---|---|
| 900,953 | 10/1908 | Reber | 206/624 |
| 1,180,541 | 4/1916 | Roden | 206/606 |
| 2,773,634 | 12/1956 | Negoro | 206/634 |
| 3,387,736 | 6/1968 | Williamson | 220/260 |
| 3,437,257 | 4/1969 | Bua | 220/359 |
| 3,593,911 | 7/1971 | Pellaton | 206/624 |
| 3,773,248 | 11/1973 | Cecil et al. | 206/606 |
| 3,826,421 | 7/1974 | Morse et al. | 206/631 |
| 3,951,333 | 4/1976 | Forbes, Jr. et al. | 206/624 |

FOREIGN PATENT DOCUMENTS

| | | | |
|---|---|---|---|
| 1432205 | 12/1968 | Fed. Rep. of Germany | 206/606 |
| 722518 | 1/1955 | United Kingdom | 206/606 |

*Primary Examiner*—Stephen Marcus

*Assistant Examiner*—Gary E. Elkins

*Attorney, Agent, or Firm*—Siegmar Silber

[57] ABSTRACT

An improved self-supporting paper carton of the gable-top type is disclosed having formed from a paper blank therefor with a detachable tearaway portion, a carton, which upon being spent, may be readily collapsed by fully opening the top and removing a tear strip together with the removable or tearaway portion of the carton blank. The tear strip is an assemblage bonded together having a zip tab or the actual tear strip adhered to an inner lining layer which, in turn, is adhered to the removable portion of the carton blank. The tear strip assembly is inserted into a cavity in the carton blank at the lower edge of the erected self-supporting paper carton and is dimensioned so that the transverse dimension of the tear strip is greater than that of the removable portion. After insertion, the tear strip assembly is compressed and the inner lining layer is then in conformal relation with exterior surface of the removable portion and with the perforations therebeyond. The conformance of the inner lining layer ensures a leak proof seal about the tear strip assembly. For packaging display purposes, a cover portion is provided of similar material to the face of the carton to provide for continuous printing of the carton graphics without substantial interruption by the tear strip installation.

16 Claims, 3 Drawing Sheets

CARTON

BACKGROUND OF THE INVENTION

1. Field of the Invention

This invention relates to an improved carton having a gable top and more particularly with a tear strip-released bottom permitting the collapsing of the carton for disposal purposes.

2. Disclosure Information Statement

In anticipation of preparing this application, a pre-examination patentability search was conducted. The search which was conducted in Class 229/41 and 206/608, 606, 605, and 611, uncovered the following:

| Patent No. | Inventor | Date of Issue |
|---|---|---|
| 1,947,865 | H. V. March | 2/20/34 |
| 2,229,461 | W. A. Clanon | 10/20/42 |
| 2,836,343 | T. Will | 5/27/58 |
| 3,204,849 | J. O. Vinney | 9/7/65 |
| 3,833,113 | J. Osier | 9/3/74 |
| 3,873,017 | D. Blatt | 3/25/75 |

While some of the elements of the disclosed carton of this invention are shown in the art recited hereinabove, no patent shows a combination of a reclosable gable top carton (for opening and closing) with a tearstrip-released bottom (for convenient disposal).

In the past, milk and orange juice in gable-top cartons, as manufactured under license from the Pure-Pak Division of Ex-Cell-O Corporation, Walled Lake, Mich., and utilizing blanks from the Liquid Packaging Division of International Paper have experienced widespread distribution. The duty of disclosure and the presence-at-the-kitchen-table test require discussion of this commonplace packaging item.

SUMMARY OF THE INVENTION

An improved-self-supporting paper carton of the gable-top type is disclosed having formed from a paper blank therefor with a detachable tearaway portion, a carton, which upon being spent, may be readily collapsed by fully opening the top and removing a tear strip together with the removable or tearaway portion of the carton blank. The tear strip is an assemblage bonded together having a zip tab or the actual tear strip adhered to an inner lining layer which, in turn, is adhered to the removable portion of the carton blank. The tear strip assembly is inserted into a cavity in the carton blank at the lower edge of the erected self-supporting paper carton and is dimensioned so that the transverse dimension of the tear strip is greater than that of the removable portion. After insertion, the tear strip assembly is compressed and the inner lining layer is then in conformal relation with exterior surface of the removable portion and with the perforations therebeyond. The conformance of the inner lining layer ensures a leak proof seal about the tear strip assembly. For packaging display purposes, a cover portion is provided of similar material to the face of the carton to provide for continuous printing of the carton graphics without substantial interruption by the tear strip installation.

OBJECTS AND FEATURES OF THE INVENTION

It is an object of the present invention to provide an improved gable-top carton with a tear-strip built into the lower edge thereof to provide for easy collapsing of the spent carton.

It is a further object of the present invention to provide a carton with improved disposability which is both easy and economical to manufacture.

It is a yet further object of the present invention to provide a tear strip of a nature which facilitates incorporation into present production techniques.

It is a still further object of the present invention to provide a tear strip for collapsing of the spent carton while maintaining the carton in a leak proof condition.

It is a feature of the present invention that, for ease of disposal, upon removal of the tear assembly, the bottom seal is hingedly extended and the carton is readily flattened.

It is a further feature of the present invention that, for ease of disposal, a tear strip assembly is housed in a cavity therefor, and as part of the assembly, a conformable inner lining seals the cavity.

Other objects and features of the invention will become apparent through the reading of the detailed description of the preferred embodiment which description references the accompanying drawings.

BRIEF DESCRIPTION OF THE DRAWINGS

In the drawings which follow the same parts shown in various views are afforded the same reference numbers.

DETAILED DESCRIPTION OF THE PREFERRED EMBODIMENTS

In the description which follows, an ordinary gable-top carton is described in combination with a tear strip assembly installed in the lowermost portion of the panels thereof. Although described in this manner, it is a teaching of this disclosure that the technique and the technology is more broadly applicable to what is know as the self-supporting paper carton art. This area of technology is broader than the gable-top carton, but the combination is described in this context solely as a matter of convenience.

Figure 1:
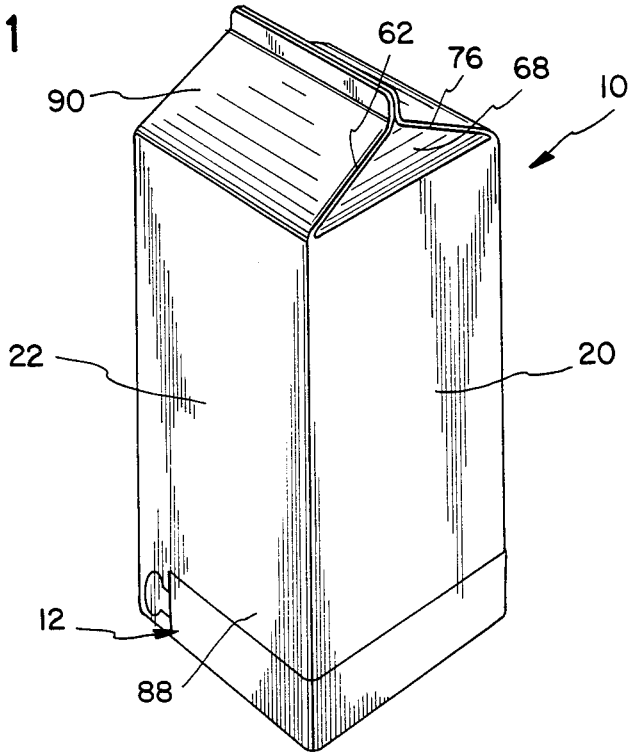
FIG. 1 is a perspective view of the improved carton of this invention, said carton having a tear-strip released bottom portion.
Figure 2:
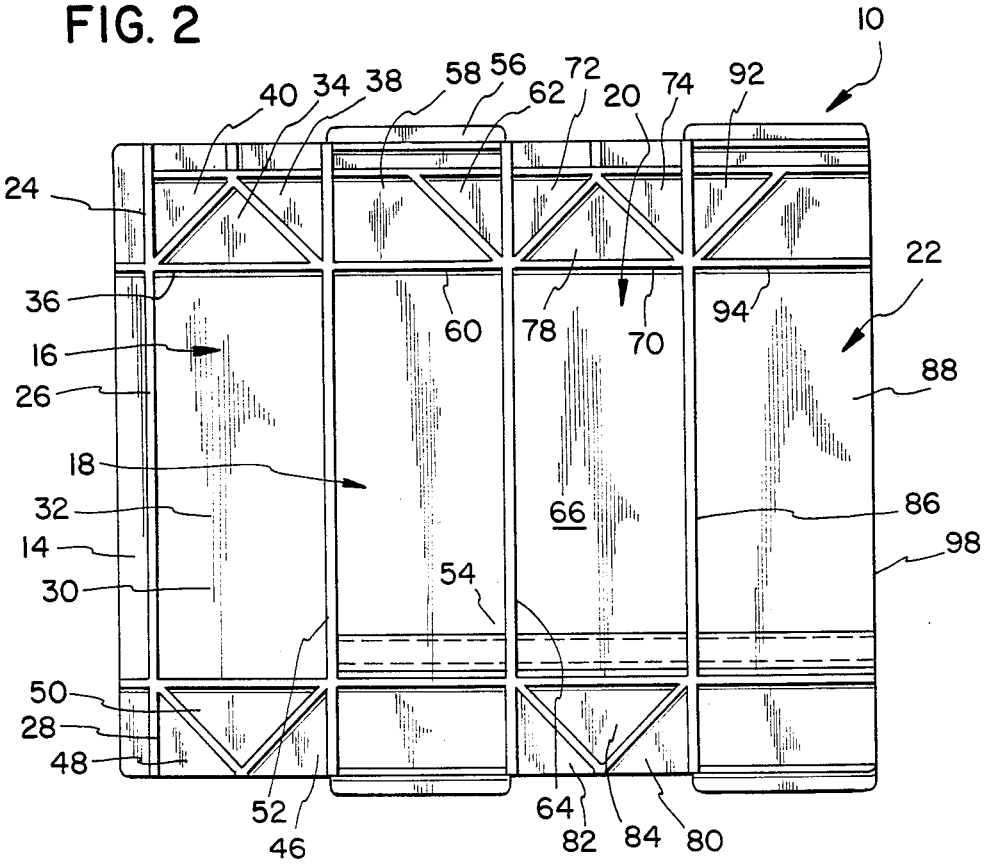
FIG. 2 is a plan view of the carton blank for this invention, said carton blank shown from the interior side thereof.
Figure 3:
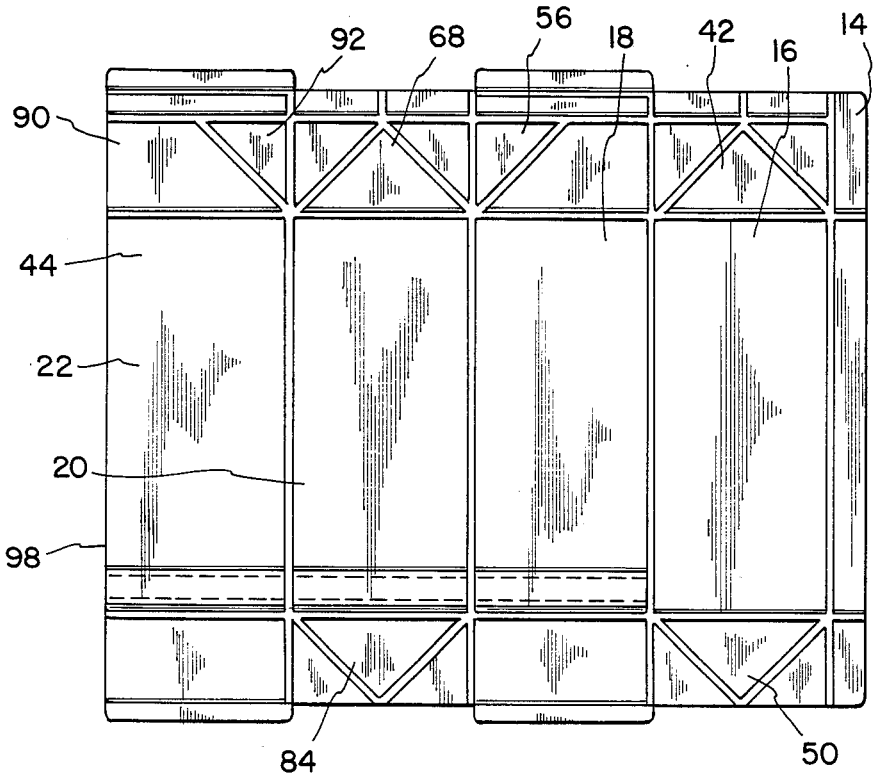
FIG. 3 is a plan view of the carton blank for this invention, said carton blank shown from the exterior side thereof.
Figure 4:
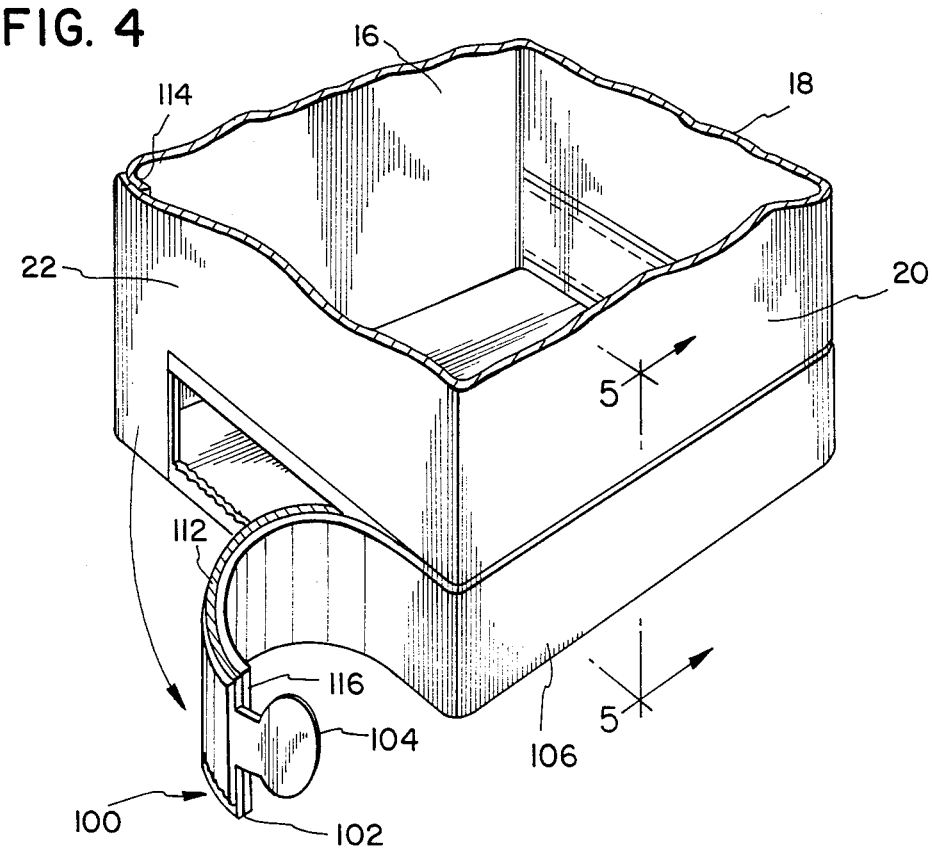
FIG. 4 is a detailed perspective view of the lower portion of the carton shown partially broken away to show details of the tear strip assembly; and, FIG. 5 is a detailed cross-sectional view of the tear strip assembly.
Figure 5:
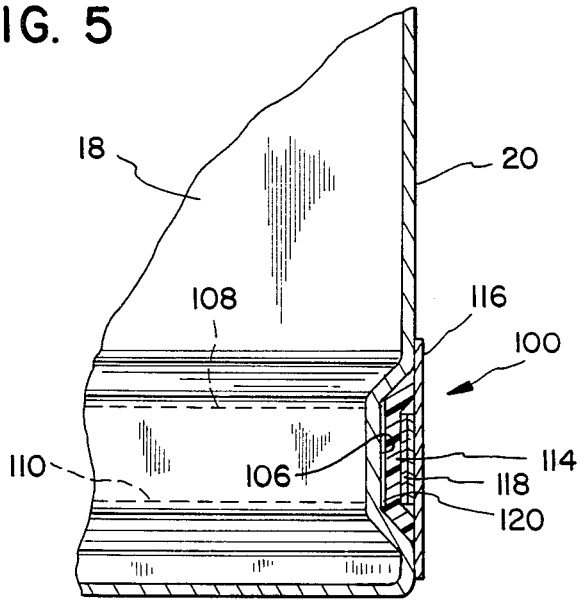

Referring now to FIGS. 1, 2, and 3, a typical gable-top carton blank is shown combined with the tear-strip assembly of this invention. The carton and the carton blank are referred to generally and interchangeably by the reference numeral 10 and the tear strip assembly by the reference numeral 12. For purposes of identification and orientation, the blank 10 selected is arranged and scored to form a one-half gallon carton and has a flange 14 and four rectangular panel members 16, 18, 20 and 22. The flange 14 and panel members 16, 18, 20 and 22 are in turn each divided into three portions, namely, gable-top portion 24, body portion 26, and bottom seal portion 28. Panel member 16, when viewed from the interior side 30 of the blank 10 (with the gable at the top), attaches on the left side thereof to flange 14 and forms the rear panel 32 of the carton 10. In the arrangement at hand, panel member 16 is scored so that the gable-top portion 24 thereof forms the sealed end 34 of the gable (the exterior of which usually bears the legened "OPEN OTHER SIDE"), and is attached to the rear panel 32 along near panel top juncture 36. The sealed end 34 is scored so that, when the blank 10 is assembled into carton form right hand triangular portion 38 abuts right side panel 18 and left-hand triangular portion 40 abuts left side panel 22. In the carton form, the top triangular portion 42 is positioned to provide the slanted sealed gable end. The bottom seal portion 28 of panel member 16 is scored so that, when the blank 10 is assembled into carton form, the exterior side 44 of right hand bottom seal triangular portion 46 and of left hand bottom seal triangular portion 48 are constructed to be adhered to the exterior side 44 of the first bottom triangular portion 50. Correspondingly, the interior side 30 of right hand bottom seal triangular portion 46 is constructed to be adhered to the interior side 30 of right side panel 18 and the interior side 30 of left hand bottom seal triangular portion 48 is constructed to be adhered to the interior side 30 of left side panel 22. Panel member 18, when viewed from the interior side 30 of the blank 10 (with the gable at the top), attaches on the left side thereof to panel member 16 along first panel juncture 52 and forms the right side panel 54 of the carton 10. In the arrangement at hand, the panel member 18 is scored so that the gable-top portion 24 thereof forms the right slanted side 56 of the gable and the right exterior portion 58 of the spout (the interior of which usually bears the legend "PUSH UP HERE") and is attached to the right side panel 54 along right side panel juncture 60. The right slanted side 56 is scored so that, when the blank 10 is assembled into carton form, right exterior portion 58 of the spout abuts front panel 20. In the carton form, the right exterior portion 58 is positioned to provide the spout right wing portion 62 described in greater detail hereinbelow. The bottom seal portion 28 of panel member 18 is unscored so that, when the blank 10 is assembled into carton form, the interior side 30 thereof adheres to the interior side 30 of right-hand bottom seal triangular portion 46 and a corresponding portion of front panel 20. Panel member 20, when viewed from the interior side 30 of the blank 10 (with the gable at the top), attaches on the left side thereof to panel member 18 along second panel juncture 64 and forms the front panel 66. In the arrangement at hand, panel member 20 is scored so that the gable-top portion 24 thereof forms the spout 68 of the gable, and is attached to the front panel 66 along front panel top juncture 70. The sealed spout 68 is scored so that, when the blank 10 is assembled into carton form the left hand triangular spout portion 72 abuts spout right wind portion 62 and the right-hand triangular spout portion 74 abuts left side panel 22. The spout right wing portion 62 and the left-hand triangular spout portion 72, upon assembly, are constructed to form the right wing 76 of spout 68. In the carton form, the top triangular spout portion 78 is positioned to provide the inwardly slanted spout portion when the gable end is sealed. The bottom seal portion 28 of panel member 20 is scored so that, when the blank 10 is assembled into carton form, the exterior side 44 of right-hand bottom seal triangular portion 80 and of left-hand bottom seal triangular portion 82 are constructed to be adhered to the exterior side 44 of the second bottom triangular portion 84. Correspondingly, the interior side 30 of right hand bottom seal triangular portion 80 is constructed to be adhered to the interior side 30 of right side panel 22 and the interior side 30 of left hand bottom seal triangular portion 82 is constructed to be adhered to the interior side 30 of right side panel 18. Panel member 22, when viewed from the interior side 30 of the blank 10 (with the gable at the top), attaches on the left side thereof to panel member 20 along third panel juncture 86 and forms the left side panel 88 of the carton 10. In the arrangement at hand, the panel member 22 is scored so that the gable-top portion 24 thereof forms the left slanted side 90 of the gable and the left exterior portion 92 of the spout (the interior of which usually bears the legend "PUSH UP HERE") and is attached to the left side panel 88 along left side panel juncture 94. The left slanted side 90 is scored so that, when the blank 10 is assembled into carton form, left exterior portion 92 of the spout abuts the right-hand triangular spout portion 74. In the carton form, the left exterior portion 92 is positioned to provide the spout left wing 92 of spout 68. The bottom seal portion 28 of panel member 22 is unscored so that, when the blank 10 is assembed into carton form, the side 44 thereof adheres to the interior side 30 of right-hand bottom seal triangular portion 80 and the interior side 30 of the left-hand bottom seal triangular portion 48. In the carton form, the exterior side 44 of flange 14 is constructed to be adhered to the interior side 30 of the right-hand edge portion 98 of panel member 22.

Referring now to FIGS. 1, 2, 3, and 4, the tear-strip assembly 12 is discussed in conjunction with the previously described carton 10. Adjacent the bottom seal portion 28, a tear strip 100 is embedded in the lower part of body portion 16 of panel members 18, 20 and 22. The tear strip assembly 12 has at the exposed end 102 thereof and is structured to include a pull tab or ring 104. The tear strip of zip tab 100 is a flat ribbon-like piece of high strength material and is housed in a longitudinally extending tear strip cavity 106 within body portion 26 of panel members 18, 20, and 22. In the base of the cavity 106, a pair of parallel perforations 108 and 110 are arrayed and communicated between the cavity and interior surface 30. The perforations are constructed so that, when normal forces are applied to the pull tab the tear strip assembly is removed together with the removable portion 112 of the blank intermediate the perforations 108 and 110. Between the tear strip 100 and the removable portion 112, an inner lining layer or strip 114 is disposed. The inner lining layer 114 is dimensioned to extend transversely beyond the perforations 108 and 110 and is constructed to conform to the cavity and to provide a leakproof seal when installed. Optionally, a cover layer 116 is mounted atop the tear strip 100 and is constructed to provide a continuous exterior surface 44. With the cover layer 116 in place, only the pull tab 104 is visible on the exterior surface 44 of blank 10 and only the perforations 108 and 110 are visible on the interior surface 30. In structuring the teat strip assembly 12, the bond 118 between tear strip 100 and inner lining layer 114 and the bond 120 between inner lining layer 114 and removable portion 112 are selected for greater strength than the breakaway forces required to remove the tear strip assembly 12 and removable portion 112 from the carton 10. In the structure just described, an inner lining layer 114 is constructed of a conformable material such as a food-grade, self-skinned plastic foam band. While other sealingly conformable materials may be used, the abovedescribed foam band is by way of example which may be varied by one skilled in the packaging art.

In operation, a blank 10 with a tear-strip receiving cavity 106 is flexed at the perforations 108 and 110 and a Correspondingly flexed inner lining 114, to which a tear strip 100 has previously been bonded, is inserted therein. Upon insertion the tear strip assembly has the exposed end 102 thereof including the at the right-hand edge of panel member 22 and the other end adjacent first panel juncture 52. In this manner, upon the blank 10 being assembled into carton form, the flange 14 backs up the exposed end or "handle" area 102. After insertion, a cover 116 is emplaced and heat and pressure is applied to the assemblage. This activates the heat-activated bond 120 between inner lining 114 and removable portion 112 and conforms inner lining 114 to seal perforations 108 and 110. The cover 116 allows the processer to finish the exterior of the carton in a manner similar to that which is currently employed.

The end-user or consumer, upon using the contents of the carton is instructed to pull the zip tab 100 (at the exposed end or handle 102) and release the three sides of bottom seal 28 from the bottom edge of panel member 11 by tearing the perforations 108 and 110 until the third panel juncture 82 is reached then from the bottom edge of panel member 24 by continuing the tearing the perforations 108 and 110 until the second panel juncture 64 is reached, and finally be tearing the perforations 108 and 110 until the first panel juncture 52 is reached. At this point, with the gable-top seal fully opened, the bottom seal 28 is extendable hingedly downward (being attached to the bottom of black panel member 32) and the carton 10 folds substantially flat along for example panel junctures 52 and 82.

While the above is exemplary of a tear-strip application for use with a self-supporting gable-top carton, other similar applications for paper cartons are taught hereby. The use of this particular configuration is instructional in nature and other configurations for easy disposal are within the purview of one skilled-in-the art.

What is claimed as new and useful is:

1. A self-supporting paper carton of a gabled-top type comprising:

a sheet paper carton blank for forming upon appropriate folding and securing said paper carton, in turn comprising;

a body portion for reception of goods having four rectangular side panels arranged side-by-side and having three parallel fold lines therebetween, and body portion, in a formed condition, being substantially square in cross section;

a top seal portion in the formed condition being a sealed extension of said body portion providing, upon operating to an open condition, a pour spout for dispensing goods received by the carton, and, after an initial operation to said open condition, for further operation to a closed condition, to store goods received by the carton; and, a bottom seal portion in the formed condition, being a substantially square, sealed extension of said side panels;

detachment means for frangibly disconnection three of the four side panels of said bottom portion; and, sealing means for securing during carton formation said body portion, said top seal portion, and said bottom seal portion in a predetermined relative, folded position; and whereby upon emptying said self-supporting paper carton, the top seal portion is fully opened and the detachment means is operated to disconnect the bottom seal portion from three of the four side panels permitting the carton to fold flat for convenient disposal thereof.

2. A self-supporting paper carton as described in claim 1 wherein said carton blank further comprises;

a flange portion attached and contiguous to one open edge of said four rectangular side panels;

and wherein:

said pour spout is formed from an extension of a central one of said four side panels;

whereby the flange portion extends into an end of the gable top opposite the pout spout.

3. A self-supporting paper carton as described in claim 2 wherein said carton blank further comprises;

at least two substantially parallel lines of perforations in the body portion defining a removable portion said bottom seal portion and traversing two central one of said four side panels and an edge panel without said flange portion attached thereto.

4. A self-supporting paper carton as described in claim 3 wherein said detachment means is a tear strip assembly comprising, in turn:

a tear strip;

an inner lining band attached to said tear strip, said inner living band being wider than the removable portion and being in conformal relationship with the carton blank to seal the perforations of the carton blank.

5. A self-supporting paper carton as described in claim 4 wherein said tear strip assembly further comprises:

strip-to-band bond means for attaching the tear strip to inner lining band; and, band-to-blank bond means for attaching the inner lining band to the removable portion, said strip-to-band bond means and said band-to-blank bond means having bond strengths greater than that required to breakaway the removable portion of the carton blank.

6. A self-supporting paper carton as described in claim 5 wherein said band-to-blank bond means is a temperature activated adhesive.

7. A self-supporting paper carton as described in claim 5 wherein said tear strip has an exposed end lying, upon erection of the carton, atop said flange portion.

8. A self-supporting paper carton as described in claim 5 wherein said tear strip assembly further comprises:

a cover portion adhered to exterior of the tear strip and band assemblage when viewed after carton formation.

9. A paper carton blank for a self-supporting carton comprising, in combination:

a body portion for reception of goods having four rectangular side panels arranged side-by-side and having three parallel panel junctures therebetween, said body portion, in a formed condition, being substantially rectangular in cross section;

a top seal portion having a pour spout for dispensing goods received by the carton, said spout operable between an open condition and a closed condition;

a bottom seal portion in the formed condition being a substantially rectangular, sealed extension of said side panels;

a flange portion attached to and continguous to one open edge of said four rectangular side panels;

at least two substantially parallel lines of perforations in the body portion defining a removable portion thereof, adjacent said bottom seal portion, and transversing the three side panels, exclusive of said side panel with said flange portion attached thereto;

detachment means for frangibly disconnecting three sides of said bottom seal portion;

an inner lining band attached to a tear strip, said inner lining band being wider than the removable portion and being in conformal relationship with the body portion to seal the perforations;

sealing means for securing during carton formation said body portion, said top seal portion, and said bottom seal portion in a predetermined relative, folded position; and, whereby upon emptying said self-supporting paper carton constructed from the carton blank, the top seal portion is fully opened and the detachment means is operated to disconnect the bottom seal portion from three of the four side panels permitting the carton to fold flat for convenient disposal thereof.

10. A self-supporting paper carton as described in claim 9 wherein said tear strip assembly further comprises:

strip-to-band bond means for attaching the tear strip to inner lining band, having a bond strength greater than that required to breakaway the removable portion of the carton blank.

11. A paper carton blank as described in claim 9 wherein said blank futher comprises a tear strip cavity at least coextensive with, said perforated body portion, communicating with said perforations, and medially to an interior face and an exterior face of the blank.

12. A paper carton blank as described in claim 11 wherein said tear strip assembly further comprises:

band-to-blank bond means for attaching the inner lining band within the tear strip cavity and to the removable portion, said band-to-blank bond means having a bond strength greater than that required to breakaway the removable portion of the carton blank.

13. A paper carton blank as described in claim 12 wherein said bond-to-blank bond means is a heat-activated adhesive, and, upon attaching the tear strip assembly to the removable portion, heat and pressure is applied for activating the adhesive and conforming the inner lining band to the tear strip cavity.

14. Tear strip assembly for use in a self-supporting paper carton having a removable portion defined by a perforated area in the carton blank comprising, in combination:

a tear strip;

an inner lining band attached to said tear strip, said inner living band being wider than the removable portion and being in conformal relationship with the carton blank to seal the perforations of the carton blank, strip-to-band bond means for attaching the tear strip to the inner lining band; and, band-to-blank bond means for attaching the inner lining band to the removable portion, said strip-to-band bond means and said band-to-blank bond means having bond strengths greater than that required to breakaway the removable portion of the carton blank; and said tear strip has an exposed end lying, upon erection of the carton, atop an exterior surface thereof.

15. A tear strip assembly as described in claim 14 wherein said band-to-blank bond means is a temperature activated adhesive.

16. A tear strip assembly as described in claim 14, wherein said tear strip assembly further comprises:

a cover portion adhered to exterior of the tear strip and band assemblage when viewed after carton formation.

* * * * *